United States Patent [19]

Bareaud

[11] Patent Number: 4,788,923

[45] Date of Patent: Dec. 6, 1988

[54] SAILING CRAFT

[76] Inventor: Jean P. Bareaud, 16 rue des 4 Diables, 17220 La Jarne, France

[21] Appl. No.: 114,864

[22] Filed: Oct. 30, 1987

[30] Foreign Application Priority Data

Nov. 4, 1986 [EP] European Pat. Off. ..... 86402457.5

[51] Int. Cl.[4] ..... B63B 35/00

[52] U.S. Cl. ..... 114/39.1; 114/91; 114/104

[58] Field of Search ..... 114/89–91, 114/102–105, 39.1, 39.2

[56] References Cited

U.S. PATENT DOCUMENTS

| | | | |
|---|---|---|---|
| 2,724,356 | 11/1955 | Szakacs | 114/39.1 |
| 3,340,841 | 12/1965 | Brazier | 114/39 |
| 3,598,075 | 8/1971 | Kenney | 114/102 |
| 4,469,040 | 9/1984 | Gougeon et al. | 114/104 |
| 4,474,126 | 10/1984 | King | 114/90 |

FOREIGN PATENT DOCUMENTS

| | | | |
|---|---|---|---|
| 3217675 | 11/1983 | Fed. Rep. of Germany | 114/39.2 |
| 2470046 | 5/1981 | France . | |

OTHER PUBLICATIONS

European Search Report.

*Primary Examiner*—Joseph F. Peters, Jr.
*Assistant Examiner*—Jesûs D. Sotelo
*Attorney, Agent, or Firm*—Stevens, Davis, Miller & Mosher

[57] ABSTRACT

Sailing craft having a mast supporting a large sail; the mast is curved towards the prow of the craft, the large sail being attached to the mast on the same side as the convexity of the curve; the rigging comprises a jib, the hoist of which is connected at its ends to the base and the top of the mast respectively, while the free top of the jib opposite the hoist is equipped with a sheet making it possible to adjust the unfurling of the jib.

8 Claims, 3 Drawing Sheets

SAILING CRAFT

Some sailing craft of a sports type, such as, for example, sailboards, have a relatively high mast for supporting a sail of large area. This results in difficulties in terms of stability, so that only very experienced pilots can take part in major races in a sea which is at all rough. Moreover, a relatively large amount of force must be exerted in order to put the mast and the sail in place at the start.

Furthermore, on these craft which have a rotating mast controlled by a wishbone, it is difficult to attach a jib arranged in the usual way to the sail.

The present invention provides substantial improvements in terms of what has just been described and can be put into practice on all types of craft using a sail to propel them, such as sailboards, sand yachts, and all sailing boats (single-hull, multi-hull, etc).

A first improvement constituting a first characteristic of the invention involves giving the mast a curve facing towards the front of the boat, the mainsail or principal sail being arranged on the mast on the same side as the convexity of the curve.

As a result of this improvement, it becomes possible to add a jib, of which the side, usually called the "hoist", has its tack no longer attached independently, as is customary, but fastened to the bottom of the mast, while the upper end of the hoist is likewise fastened to the mast in its upper part, the free top of the jib opposite the hoist receiving a sheet which makes it possible to adjust the unfurling of the jib towards the mainsail. This is the second of the improvements which are the subject of the invention.

In this arrangement, the corridor for the passage of the wind between the jib and mainsail opens between the hoist of the jib and the mast as a result of the curve of the latter. The sheet can be adjustably fastened to the mainsail securing system, so that an assembly comprising the mainsail and the jib follows the rotation of the mast, without the need to change the adjustment of the jib, at least where small rotations are concerned.

As may be appreciated, this combination makes it possible to provide the pilot with a double sail controlled during the rotation of the mast. Consequently, it is possible to reduce the height of the mast considerably and thereby lower the point of application of the thrust of the wind or the centre of effort, at the same time having an equal or greater sail area. This results in a substantial improvement in stability and a considerable reduction in the force required to put the mast in place initially or after a fall and to keep the mast in place during sailing. Moreover, the effect of adding the jib which is opposite the mainsail in relation to the mast is to bring the centre of effort nearer to the axis of rotation of the mast and therefore to reduce the force necessary to rotate the mast.

Other improvements will emerge from the following description, with reference to the drawings given by way of example.

Figure 1:
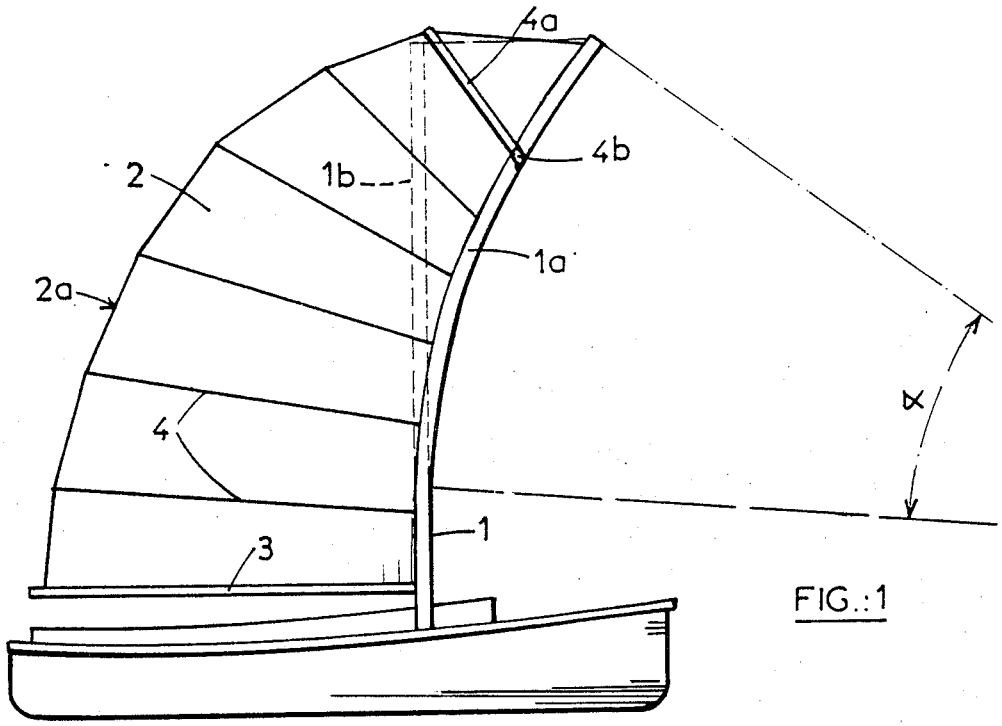
FIG. 1 is an elevation view of a small sailing craft equipped with a mast according to the invention.

FIG. 1 shows a small sailing craft, for example of the drop-keep type, of which the mast 1, instead of being straight or slightly curved towards the stern, as is customary, on the contrary has a curve directed towards the prow. In the Figure, the curve of circular shape extends over an angle of approximately 30°. This angle can vary more or less, depending on the craft equipped and the desired results. The curve can start at the step of the mast. The mast is equipped with a sail 2 attached by conventional means to the rear of the mast, that is to say on the same side as the convex part of the curve. Likewise, the sail is attached at its base to a boom 3 in the usual way.

As shown by the broken lines **1*b*** representing a conventional straight mast of the same height as the curved mast, the sail area obtained by means of the curved mast is increased. As a result, for one and the same sail area, it is possible to reduce the height of the mast, and this is beneficial to stability.

The sail is preferably equipped with laths 4 to give it a certain amount of rigidity and to ensure, as far as possible, that its drop edge **2*a*** follows a contour similar to that of the mast.

To allow the sail to hold in light squalls, it will advantageously be arranged in such a way that some of its surface near its drop edge can warp under the action of high wind pressure. For this purpose, the upper lath **4*a* made of flexible material will be fastened to the mast at its end 4*b*, whereas the other laths are free relative to the mast, merely being connected to the sail. The upper lath 4*a***, while at the same time being flexible, will have a sufficient cross-section to withstand a wind or normal force and bend only under heavy squalls, then allowing the sail to warp.

Figure 2:
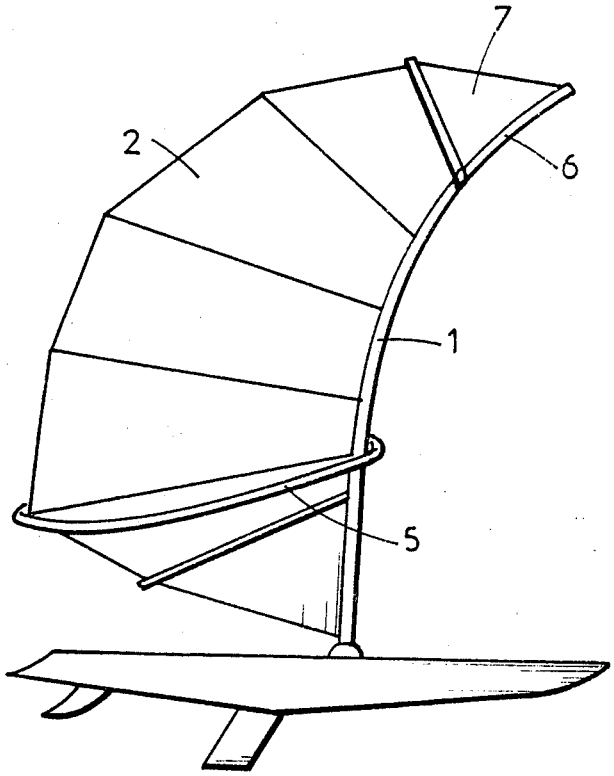
FIG. 2 is a view similar to FIG. 1, but shows a sailboard.
Figure 3:
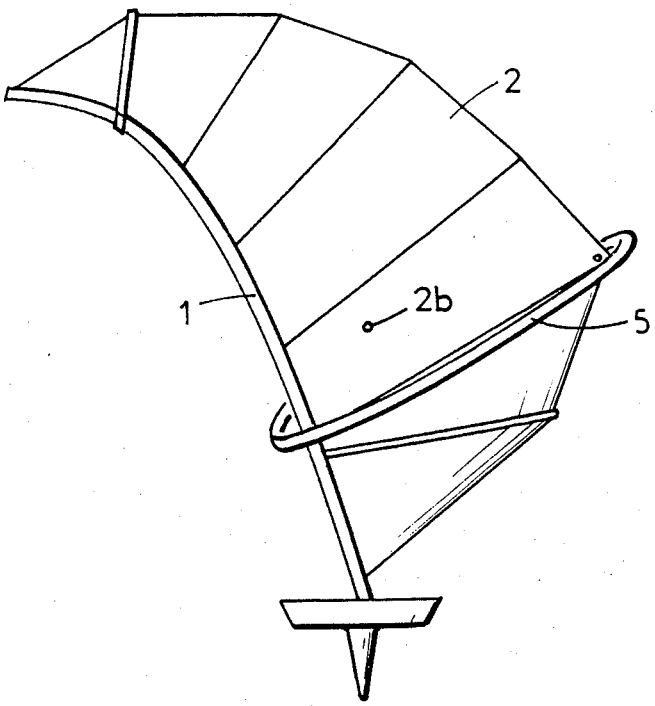
FIG. 3 is an end view of the sailboard and shows the sail rotated 90% in order to sail before the wind.

FIGS. 2 and 3 show the curved mast used on a sailboard.

As is known, in this type of craft the mast is mounted by means of a ball joint, so that it can rotate on itself and assume all angles of inclination, the rotation and inclination being controlled by means of a wishbone 5 held by the pilot.

It was found that, on these craft, the new mast has various advantages in addition to the possibility of reducing the height of the mast and consequently improving stability while at the same time reducing the force necessary to put the mast in place after a fall.

The shape of the mast and of the sail associated with it gives rise to a mast nose 6 and a sail nose 7.

This shape allows better wind penetration and increases the suction effect when the craft comes up again close to the wind.

In FIG. 3, it will also be seen that, when the craft runs before the wind, the inclination of the mast is less than wih a straight mast if the centre of effort **2*b*** is located vertically in line with the step of the mast, thus resulting in a considerable improvement in the maneuverability of the craft.

Figure 4:
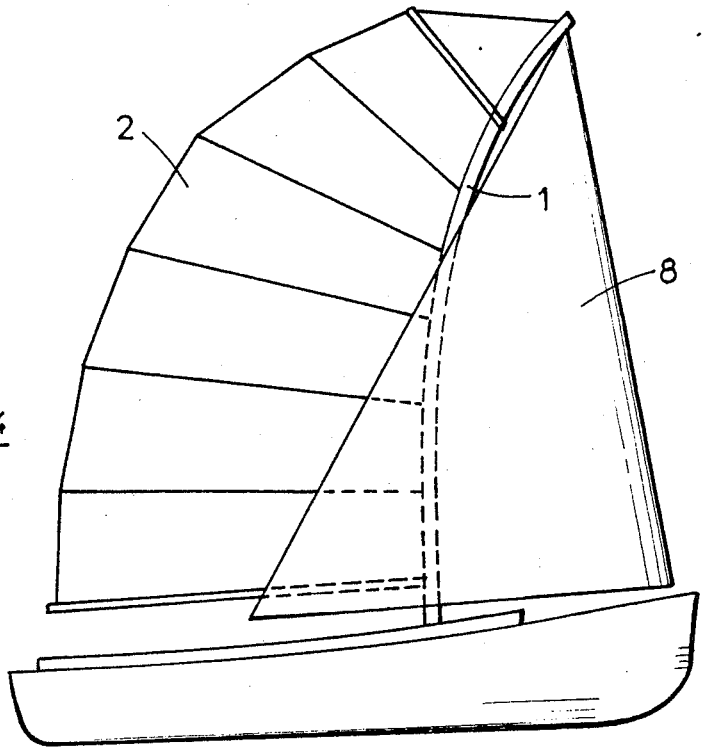
FIG. 4 is a view similar to that of FIG. 1, but shows a rigging which includes a jib.

A jib 8 mounted in the usual way can be associated with the mast, as shown in FIG. 4. Moreover,this jib could be duplicated by another jib.

However, the present invention makes it possible to take advantage of the curve of the mast to mount the jib in a special way which reinforces the advantages already mentioned and which makes it possible to achieve others.

Figure 5:
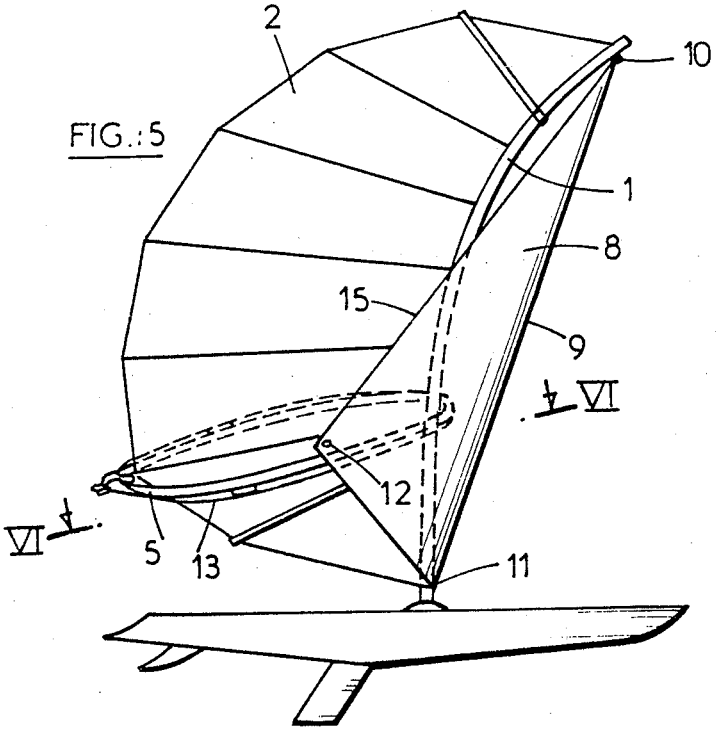
FIG. 5 illustrates a special mounting of the jib for a rigging of a sailboard or similar craft.

FIG. 5 illustrates this mounting in the particular case of a rotating mast controlled by a wishbone 5. The hoist 9 of the jib 8 is secured to the mast at its upper end 10 and at its lower end 11, while attached to the top 12 of the jib (clew) opposite the hoist is a sheet 13 which can be fastened adjustably to the wishbone, for example by means of a cleat.

It will be seen that, in such an arrangement, the jib 8 can be unfurled opposite the mainsail 2 (FIG. 5), thereby forming between the two a channel 14 (FIG. 6) which opens into the gap 17 between the curved mast and the hoist 9 of the jib. This channel, delimited by the mainsail and the jib, makes it possible to deflect a large airflow uniformly, at the same time collecting the various airstreams, thus ensuring a high propulsive thrust value.

The mainsail and the jib form an assembly, the orientation of which can be adjusted easily by action on the wishbone fastened to the mast, while for each orientation of the mainsail the relative orientation of the jib can be changed by action on the sheet 13.

Figure 6:
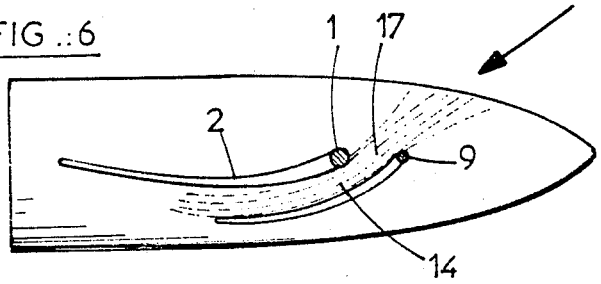
FIG. 6 is a sectional view of FIG. 5 along the line VI—VI.

During tacking, it is sufficient for the pilot to release the sheet 13 from the cleat clamping it to the wishbone, in order to ensure that, as a result of the wind action, the jib veers to the other side via the channel 17 (FIG. 6). The sheet will then be reattached to a second cleat.

As will be understood from the preceding description, the invention makes it possible to solve the problem of mounting a jib in a rigging with a rotating mast, such as that of a sailboard.

The jib which forms an additional sail makes it possible to reduce the height of the mast even further for an equal or even a little larger total sail area and consequently increase the stability.

Furthermore, since the jib is opposite the mainsail 2 in relation to the mast, the center of effort is nearer the axis of rotation of the mast, thus reducing the torque to be exerted by the pilot in order to hold the rigging as a whole in place or change its orientation.

The jib can be given a different shape from the conventional triangular shape. For example, in its part 15 opposite the hoist, it could have a rounded shape retained by means of a stiffened edge, so as to increase the surface of the jib and the overlapping of the mainsail, thus assisting the effect of collecting the airstreams.

The curved mast can be produced from any suitable materials: light wood, aluminum, pressed carbon fibers and resin, etc.

The curvature of the mast will depend on the materials used and on the area required for the sail.

On the other hand, it would not exceed the scope of the invention if, instead of a continuous curve, the mast were given a broken-line form or if there were any other addition making it possible to bring the top of the mast forwards towards the prow. The expression "curved" appearing in the claims is to interpreted in this sense.

I claim:

1. Sailing craft having a mast which is curved on its top part and whose concavity faces towards the prow of the craft, and a mainsail attached to the mast along the convex side of said mast.

2. Craft according to claim 1, wherein the mast is curved over its entire length.

3. Craft according to claim 1, wherein the mainsail is lathed.

4. Craft according to claim 1, having a plurality of laths distributed along the length of the mainsail and wherein one of the top laths is fastened to the mast, the lath so fastened being made of flexible material, having a bending resistance set so that it bends only under a heavy squall for allowing the sail to warp.

5. Craft according to claim 1, having further a jib, the hoist of which is connected at its ends to the base and the top of the mast respectively, whilst the free top of the jib opposite the hoist is equipped with a sheet for adjusting the unfurling of the jib.

6. Craft according to claim 5, wherein the mast is rotatable and has a wishbone attached thereto for adjusting its angular position, and wherein the said sheet is fastened to the wishbone adjustably.

7. Craft according to claim 5, wherein the said and the jib are arranged in such a way that the centre of effort is in the immediate vicinity of the axis of rotation of the mast.

8. Sailing craft having a rotatable curved mast whose concavity faces towards the prow of the craft, a wishbone attached to said mast for adjusting its angular position and a lathed mainsail attached to said mast along its convex side

* * * * *